US008174304B2

(12) United States Patent
Cheng et al.

(10) Patent No.: US 8,174,304 B2
(45) Date of Patent: May 8, 2012

(54) KEY MODULE HAVING LIGHT-INDICATING FUNCTIONALITY AND A METHOD FOR CONTROLLING THE SAME

(75) Inventors: Lien-Fu Cheng, Hsinchu (TW); Wei-Chih Su, Hsinchu (TW); Jyh-Yu Chuang, Hsinchu (TW)

(73) Assignee: Coretronic Corporation (TW)

( * ) Notice: Subject to any disclaimer, the term of this patent is extended or adjusted under 35 U.S.C. 154(b) by 1254 days.

(21) Appl. No.: 11/850,498

(22) Filed: Sep. 5, 2007

(65) Prior Publication Data

US 2008/0224638 A1 Sep. 18, 2008

(30) Foreign Application Priority Data

Mar. 12, 2007 (TW) ..... 96108386 A

(51) Int. Cl.
*H05B 41/38* (2006.01)
*H05B 41/14* (2006.01)

(52) U.S. Cl. ..... 327/517; 345/170; 250/466.1; 362/800

(58) Field of Classification Search ..... None
See application file for complete search history.

(56) References Cited

U.S. PATENT DOCUMENTS

| | | | | |
|---|---|---|---|---|
| 4,866,345 | A * | 9/1989 | Kataoka | 315/84 |
| 5,932,975 | A * | 8/1999 | Wut | 315/119 |
| 7,324,168 | B2 * | 1/2008 | Griesau et al. | 348/734 |
| 7,333,031 | B1 * | 2/2008 | Bantner | 341/22 |
| 7,417,624 | B2 * | 8/2008 | Duff | 345/168 |
| 7,786,623 | B2 * | 8/2010 | Farmer et al. | 307/117 |
| 2004/0252350 | A1 | 12/2004 | Hsieh | |

FOREIGN PATENT DOCUMENTS

| | | |
|---|---|---|
| JP | 2006-049445 A | 2/2006 |
| TW | 542626 | 7/2003 |
| TW | 549960 | 8/2003 |
| TW | I254237 | 5/2006 |

* cited by examiner

*Primary Examiner* — Lincoln Donovan
*Assistant Examiner* — Terry L Englund
(74) *Attorney, Agent, or Firm* — Sheridan Ross P.C.

(57) ABSTRACT

A key module includes a key, a light emitting component, and a drive circuit. The key is operable between on and off states. The light emitting component is disposed adjacent to the key, and is capable of providing indicating light for the key. The drive circuit is electrically connected to the key and the light emitting component. The drive circuit is triggered upon switching of the key from the off state to the on state to provide a drive signal for driving the light emitting component to provide the indicating light. The drive signal has an intensity that gradually decreases over time once the key switches from the on state to the off state such that the indicating light provided by the light emitting component has a luminance that gradually decreases over time.

2 Claims, 9 Drawing Sheets

KEY MODULE HAVING LIGHT-INDICATING FUNCTIONALITY AND A METHOD FOR CONTROLLING THE SAME

CROSS-REFERENCE TO RELATED APPLICATION

This application claims priority of Taiwanese Application No. 096108386, filed on Mar. 12, 2007.

BACKGROUND OF THE INVENTION

1. Field of the Invention

The invention relates to a key module and a method for controlling the same, more particularly to a key module having light-indicating functionality and a method for controlling the key module.

2. Description of the Related Art

For an electronic device that requires to be operated in the dark, such as a projector, the design of providing keys with indicating lights facilitates clear identification of the locations of and functions associated with the keys, thereby facilitating easy operation of the electronic device in the dark.

As shown in FIG. 1, a conventional key module 9 having light-indicating functionality and adapted for use in a conventional electronic device (not shown) includes a microprocessor 90, a key set 91 including a plurality of keys 911, a drive circuit 92, and a backlight unit 93. The backlight unit 93 includes a plurality of light emitting components 931 that are respectively disposed adjacent to the keys 911 for providing indicating light around the keys 911 such that a user clearly sees and locates the keys 911 in the dark.

There are two conventional methods for designing the operation of providing the indicating light for the keys 911. In the first conventional method, as long as the microprocessor 90 is active (e.g., operating in the projecting mode), the microprocessor 90 provides a control signal to the drive circuit 92, commanding the drive circuit 92 to provide a drive signal to continuously turn on the backlight unit 93 such that the light emitting components 931 continuously provide the indicating light, regardless of whether a key 911 is pressed. In the second conventional method, the microprocessor 90 provides a control signal to the drive circuit 92, commanding the drive circuit 92 to transmit a drive signal to turn on the backlight unit 93 such that the light emitting components 931 provide the indicating light whenever one of the keys 911 is pressed.

However, in both of the conventional methods, the drive circuit 92 drives all of the light emitting components 931 in the backlight module 93 at the same time, such that all of the light emitting components 931 provide the indicating light whenever the microprocessor 90 provides a control signal to the drive circuit 92. Thus, the following shortcomings are present in the conventional methods:

1. Whether only one of the keys 911 or multiple ones of the keys 911 are pressed, all of the light emitting components 931 of the backlight unit 93 provide the indicating light, increasing the overall power consumption of the key module 9, thereby resulting in failure to comply with the energy saving requirement for a green product.

2. Individual keys 911 are not provided with corresponding light emitting components 931 that provide the indicating light only when the corresponding key 911 is pressed, thereby resulting in the user being unable to confirm which key 911 was actually pressed.

3. In the case where the backlight unit 93 is turned on such that all of the light emitting components 931 constantly provide the indicating light while the microprocessor 90 is active, a lot of energy is wasted.

SUMMARY OF THE INVENTION

Therefore, the object of the present invention is to provide a key module having light-indicating functionality and a method for controlling the same, where luminance of a light emitting component decreases over time, thereby lowering overall power consumption of the key module Consequently, accidental actuation of the key module is prevented from resulting in an undesired operation of an electronic device incorporating the key module, and the sequence of pressing multiple keys are indicated by the order of vanishing indicating lights.

According to one aspect of the present invention, a key module is provided, and the key module includes a key, a light emitting component, and a drive circuit. The key is operable between on and off states. The light emitting component is disposed adjacent to the key, and is capable of providing indicating light for the key. The drive circuit is electrically connected to the key and the light emitting component. The drive circuit is triggered upon switching of the key from the off state to the on state to provide a drive signal for driving the light emitting component to provide the indicating light. The drive signal has an intensity that gradually decreases over time once the key switches from the on state to the off state such that the indicating light provided by the light emitting component has a luminance that gradually decreases over time.

According to another aspect of the present invention, a method for controlling a key module that is operable in one of a standby mode, a sleep mode, and a control mode is provided and includes: causing the key module to operate in the standby mode, where a drive signal is provided for driving a light emitting component of the key module when a key of the key module is switched from an off state to an on state while the key module operates in the sleep mode; causing the key module to operate in the sleep mode when the key is not switched from the off state to the on state within a predefined period while the key module operates in the stand by mode; and causing the key module to operate in the control mode, where a function associated with the key is performed when the key is switched from the off state to the on state within the predefined period while the key module operates in the standby mode.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
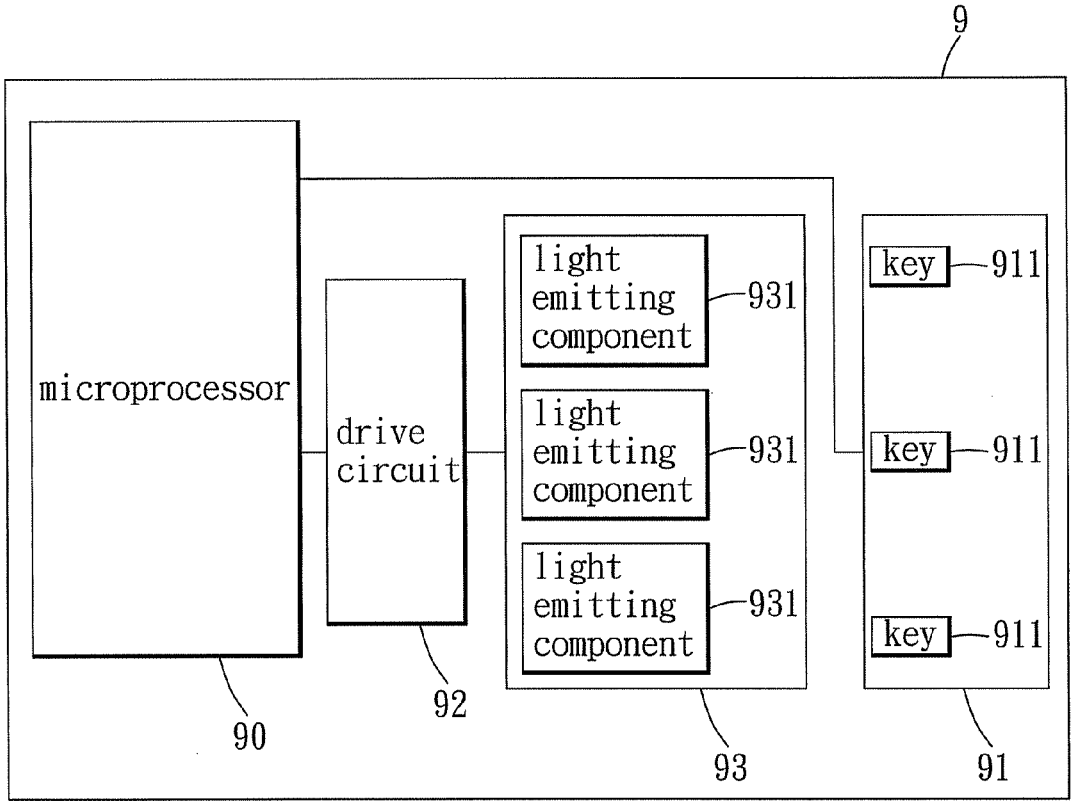
FIG. 1 PRIOR ART
FIG. 1 is a block diagram of a conventional electronic device incorporating a conventional key module.

It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless limited otherwise, the terms "connected," and "coupled," and variations thereof herein are used broadly and encompass direct and indirect connections, couplings, and mountings.

Before the present invention is described in greater detail, it should be noted that like elements are denoted by the same reference numerals throughout the disclosure.

Figure 2A:
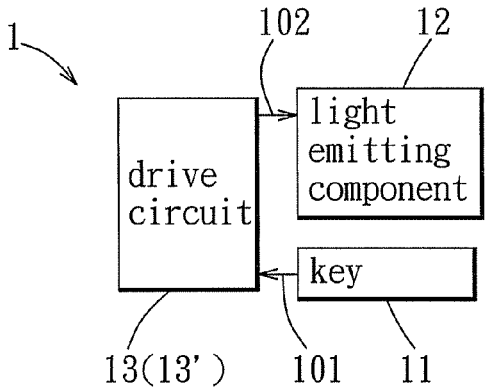
FIG. 2A is a block diagram of a key module according to a first preferred embodiment of the present invention.

As shown in FIG. 2A, a key module 1 according to a first preferred embodiment of the present invention is adapted for use in an electronic device (not shown) that requires to be operated in the dark, such as a projector device (not shown). The key module 1 includes a key 11, a light emitting component 12, and a drive circuit 13 (13'). The key 11 is operable between on and off states. The light emitting component 12 is disposed adjacent to the key 11, and is capable of providing indicating light for the key 11. In this embodiment, the light emitting component 12 is disposed directly underneath the key 11, and the key 11 is made from a light transmissive material. The drive circuit 13 (13') is electrically connected to the key 11 and the light emitting component 12. The drive circuit 13 (13') is triggered upon switching of the key 11 from the off state to the on state to provide a drive signal 102 for driving the light emitting component 12 to provide the indicating light. The drive signal 102 has an intensity that gradually decreases over time once the key 11 switches from the on state to the off state such that the indicating light provided by the light emitting component 12 has a luminance that gradually decreases over time. In this embodiment, as the key 11 switches from the off state to the on state upon being pressed by a user, the key module 1 is actuated, and a control signal 101 is provided to the drive circuit 13 (13'). The drive circuit 13 (13') provides the drive signal 102, which is a voltage signal, in response to the control signal 101.

Figure 2B:
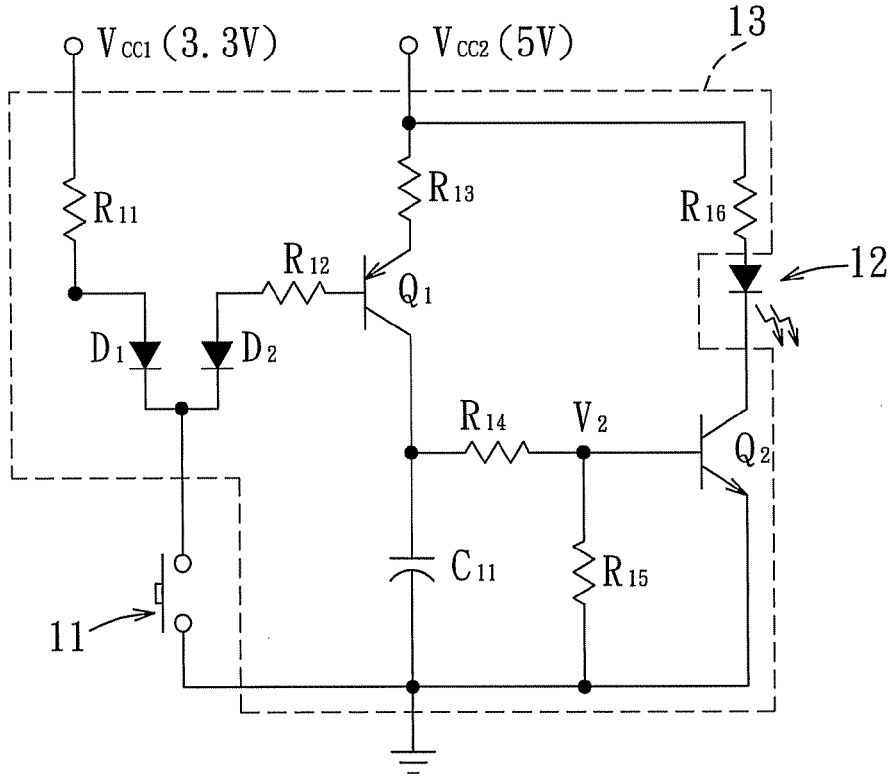
FIG. 2B is a circuit diagram of a first implementation of a drive circuit according to the first preferred embodiment of the present invention.

As shown in FIG. 2B, according to a first implementation of the first preferred embodiment, the drive circuit 13 includes a capacitor ($C_{11}$), a first transistor ($Q_1$), a second transistor ($Q_2$), a first diode ($D_1$), a first resistor ($R_{11}$), a second diode ($D_2$), a second resistor ($R_{12}$), a third resistor ($R_{13}$), a fourth resistor ($R_{14}$), a fifth resistor ($R_{15}$), and a sixth resistor ($R_{16}$).

The first transistor ($Q_1$) has a collector that is coupled to one terminal of the capacitor ($C_{11}$). The other terminal of the capacitor ($C_{11}$) is grounded. The second transistor ($Q_2$) has a collector that is coupled to the light emitting component 12, and a grounded emitter. The first diode ($D_1$) has a cathode terminal that is coupled to the key 11. The first resistor ($R_{11}$) is adapted to be coupled between a first voltage source ($V_{CC1}$) and an anode terminal of the first diode ($D_1$). The second diode ($D_2$) is coupled between a base of the first transistor ($Q_1$) and the key 11. The second resistor ($R_{12}$) is coupled between the base of the first transistor ($Q_1$) and an anode terminal of the second diode ($D_2$). The third resistor ($R_{13}$) is adapted to be coupled between a second voltage source ($V_{CC2}$) and an emitter of the first transistor ($Q_1$). The fourth resistor ($R_{14}$) is coupled between the collector of the first transistor ($Q_1$) and a base of the second transistor ($Q_2$). The fifth resistor ($R_{15}$) is coupled between the base of the second transistor ($Q_2$) and the emitter of the second transistor ($Q_2$). The sixth resistor ($R_{16}$) is adapted to be coupled between the second voltage source ($V_{CC2}$) and the light emitting component 12.

Figure 2C:
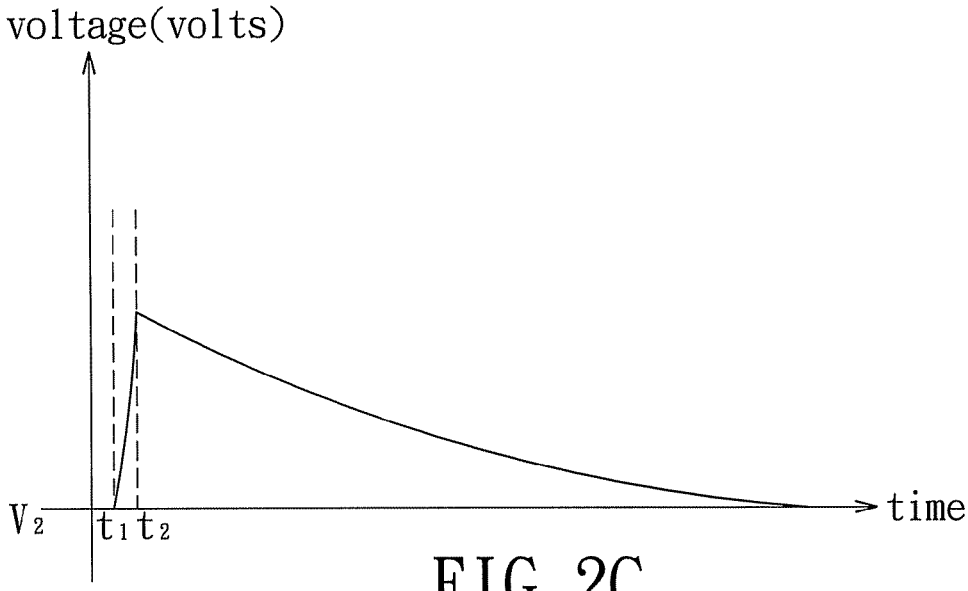
FIG. 2C is a plot illustrating a drive signal provided by the drive circuit according to the first preferred embodiment of the present invention.

As shown in FIG. 2B and FIG. 2C, when the key 11 is not pressed, the drive circuit 13 forms an open loop, and the light emitting component 12 is not turned on to provide the indicating light. Once the key 11 is pressed, at time ($t_1$), the first diode ($D_1$) and the second diode ($D_2$) are turned on, thereby turning on the first transistor ($Q_1$), such that the capacitor ($C_{11}$) is charged to a predefined voltage (e.g., 1.4 Volts) by a current supplied by the second voltage source ($V_{CC2}$) and flowing through the third resistor ($R_{13}$) and the first transistor ($Q_1$). At this time, the second transistor ($Q_2$) is turned on, thereby turning on the light emitting component 12, such that the light emitting component 12 provides the indicating light.

When the key 11 is released, at time ($t_2$), the first transistor ($Q_1$) is turned off, and the charged-up capacitor ($C_{11}$) starts to discharge via the fourth and fifth resistors ($R_{14}$), ($R_{15}$), such that the second transistor ($Q_2$) is still turned on. The discharge current of the capacitor ($C_{11}$) gradually decreases over time, such that the luminance of the indicating light provided by the light emitting component 12 gradually decreases over time. Eventually, the second transistor ($Q_2$) is turned off, and the light emitting component 12 stops providing the indicating light. In other words, the drive signal 102 provided by the drive circuit 13 is the discharge current of the capacitor ($C_{11}$), which is an analog signal.

Figure 2D:
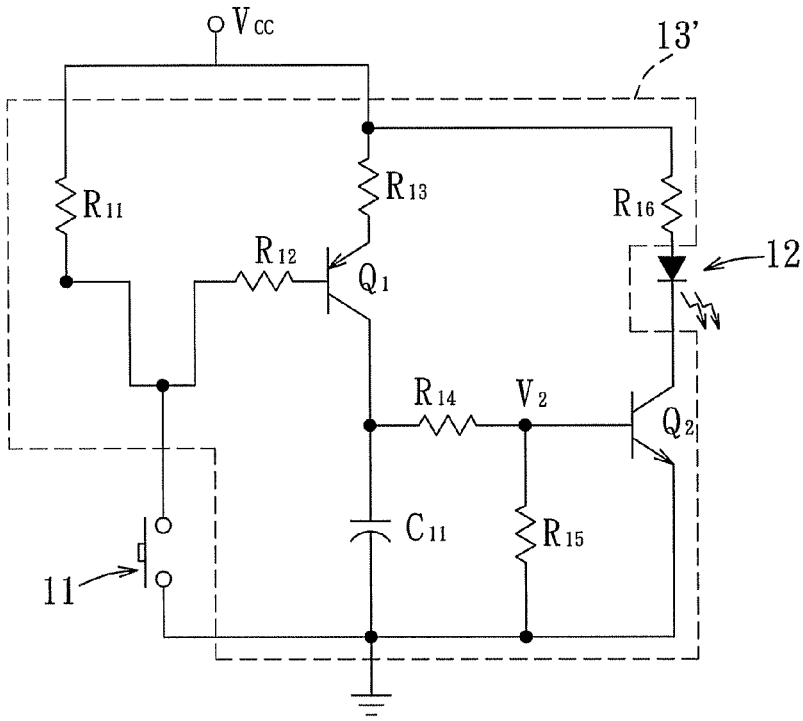
FIG. 2D is a circuit diagram of a second implementation of the drive circuit according to the first preferred embodiment of the present invention.

As shown in FIGS. 2A and 2D, according to a second implementation of the first preferred embodiment, the drive circuit 13' includes a capacitor ($C_{11}$), a first transistor ($Q_1$), a second transistor ($Q_2$), a first resistor ($R_{11}$), a second resistor ($R_{12}$), a third resistor ($R_{13}$), a fourth resistor ($R_{14}$), a fifth resistor ($R_{15}$), and a sixth resistor ($R_{16}$).

The first transistor ($Q_1$) has a collector that is coupled to one terminal of the capacitor ($C_{11}$). The other terminal of the capacitor ($C_{11}$) is grounded. The second transistor ($Q_2$) has a collector that is coupled to the light emitting component 12, and a grounded emitter. The first resistor ($R_{11}$) is adapted to be coupled between a voltage source ($V_{CC}$) and the key 11. The second resistor ($R_{12}$) is coupled between a base of the first transistor ($Q_1$) and the key 11. The third resistor ($R_{13}$) is adapted to be coupled between the voltage source ($V_{CC}$) and an emitter of the first transistor ($Q_1$). The fourth resistor ($R_{14}$) is coupled between the collector of the first transistor ($Q_1$) and a base of the second transistor ($Q_2$). The fifth resistor ($R_{15}$) is coupled between the base of the second transistor ($Q_2$) and the emitter of the second transistor ($Q_2$). The sixth resistor ($R_{16}$) is adapted to be coupled between the voltage source ($V_{CC}$) and the light emitting component 12.

The drive circuit 13' according to the second implementation of the first preferred embodiment omits the first and second diodes ($D_1$), ($D_2$) of the drive circuit 13 according to the first implementation, and the first and third resistors ($R_{11}$), ($R_{13}$) are adapted to be coupled to the voltage source ($V_{CC}$) in common.

As shown in FIG. 2C and FIG. 2D, when the key 11 is not pressed, the drive circuit 13' forms an open loop, and the light emitting component 12 does not provide the indicating light. Once the key 11 is pressed, at time ($t_1$), the drive circuit 13' forms a closed loop, turning on the first transistor ($Q_1$), and charging the capacitor ($C_{11}$) to a predefined voltage (e.g., 1.4 volts) with the current supplied by the voltage source ($V_{CC}$) and flowing through the third resistor ($R_{13}$) and the first transistor ($Q_1$). At this time, the second transistor ($Q_2$) is turned on, thereby turning on the light emitting component 12, such that the light emitting component 12 provides the indicating light.

When the key 11 is released, at time ($t_2$), the first transistor ($Q_1$) is turned off, and the charged-up capacitor ($C_{11}$) starts to discharge via the fourth and fifth resistors ($R_{14}$), ($R_{15}$), such that the second transistor ($Q_2$) is turned on. The discharge current of the capacitor ($C_{11}$) gradually decreases over time, such that the luminance of the indicating light provided by the light emitting component 12 gradually decreases over time. Eventually, the second transistor ($Q_2$) is turned off, and the light emitting component 12 stops providing the indicating light. As with the previous implementation, the drive signal 102 provided by the drive circuit 13' is the discharge current of the capacitor ($C_{11}$).

In both the first and second implementations of the drive circuit 13 (13') according to the first preferred embodiment, hardware approaches are used to implement the drive circuits 13, 13', i.e., by first charging up the capacitor ($C_{11}$), and then discharging the capacitor ($C_{11}$) so as to provide the drive signal 102 (as shown in FIG. 2A) in the form of the discharge current of the capacitor ($C_{11}$), which gradually decreases over time, for driving the light emitting component 12 such that the light emitting component 12 provides the indicating light with a luminance that gradually decreases over time, until eventually no more indicating light is provided by the light emitting component 12. As compared to the prior art, where the luminance of the indicating light provided by the light emitting component 931 (as shown in FIG. 1) is maintained at a constant level, the present invention effectively reduces the total energy consumption. Also, the indicating light informs the user of the actuation of the key 11.

Figure 3:
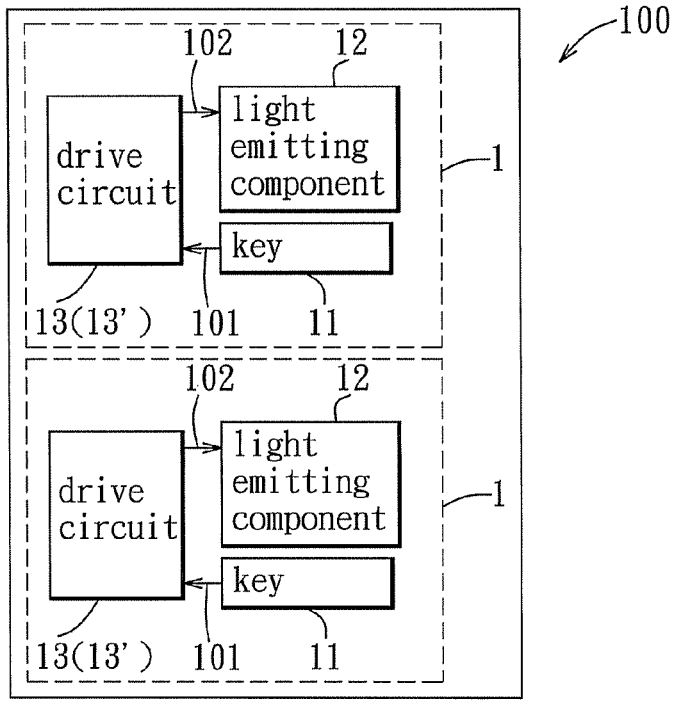
FIG. 3 is a block diagram, illustrating a circuit incorporating the key modules according to the first preferred embodiment of the present invention.

As shown in FIG. 3, a circuit 100, incorporating key modules having light-indicating functionality, includes a plurality of the key modules 1 of the first preferred embodiment. Since operations of each of the key modules 1 are identical to those disclosed hereinabove, further details of the same are omitted herein for the sake of brevity. When a user presses different key modules 1 in sequence, since the key modules 1 are identical to each other, the light emitting components 12 of the key modules 1 will stop providing the indicating light in sequence at corresponding times. Consequently, the user confirms the operating sequence of the keys 11 on the basis of the order that the light emitting components 12 stop providing the indicating light.

Figure 4:
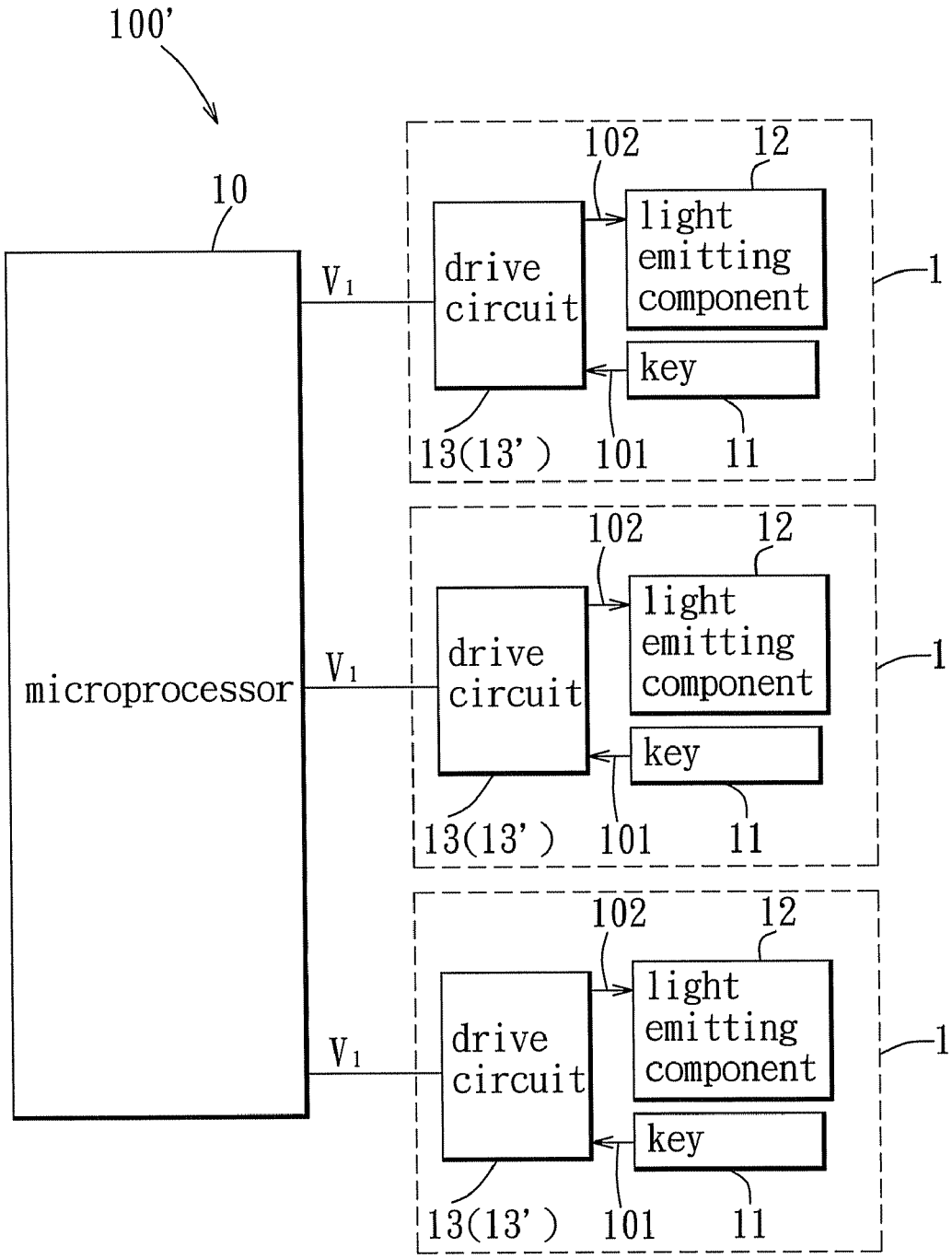
FIG. 4 is a block diagram, illustrating another circuit incorporating the key modules according to another implementation of the first preferred embodiment of the present invention.

As shown in FIG. 4, other than including the plurality of key modules 1 according to the first preferred embodiment, the circuit 100' further includes a microprocessor 10 that is commonly shared by the key modules 1. The microprocessor 10 is electrically connected to the drive circuit 13 (13') of each of the key modules 1 for performing a function associated with the key 11 of each of the key modules 1 upon detecting that the key 11 is switched from the off state to the on state. Since operations of each of the key modules 1 are identical to those disclosed hereinabove, further details of the same are omitted herein for the sake of brevity.

Figure 5:
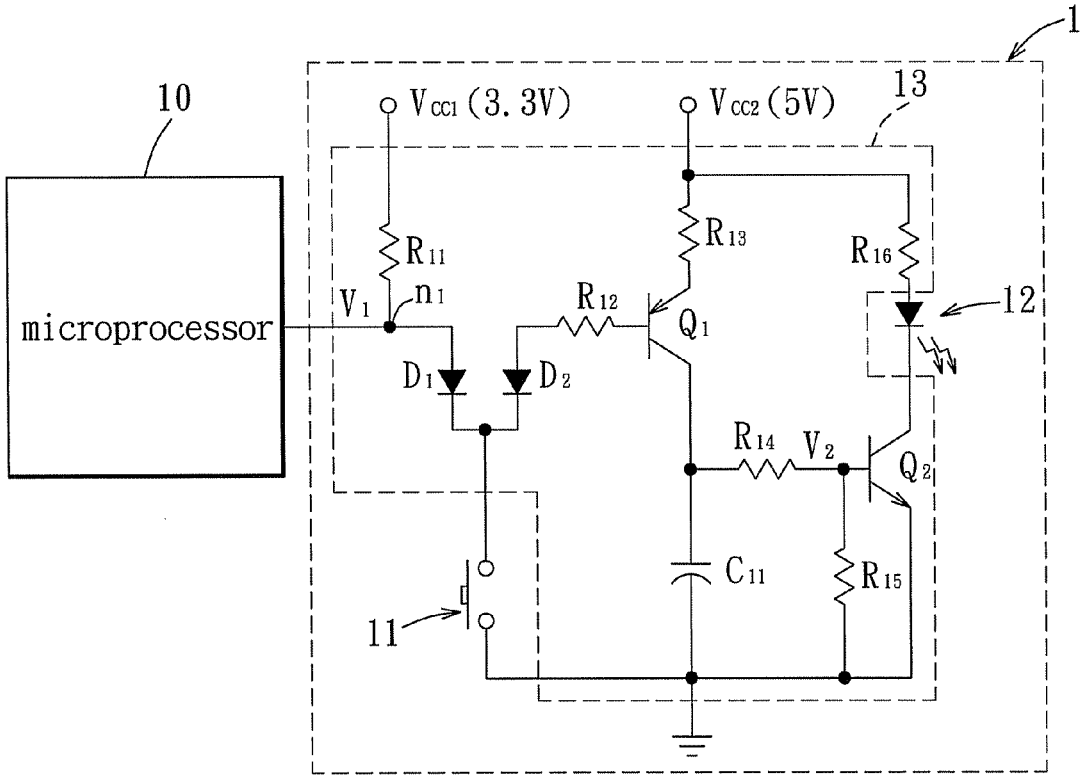
FIG. 5 is a circuit diagram, illustrating the connection between the drive circuit of FIG. 2B and a microprocessor according to the first preferred embodiment of the present invention.

Referring to FIG. 5, where only one of the key modules 1 in the circuit 100' is illustrated in FIG. 5, and where the first implementation of the drive circuit 13 according to the first preferred embodiment is taken as an example, the microprocessor 10 is electrically coupled to a junction of the first resistor ($R_{11}$) and the first diode ($D_1$) of the drive circuit 13 of each of the key modules 1. Upon switching of the key 11 of one of the key modules 1 from the off state to the on state as the key 11 is being pressed, the drive circuit 13 of the corresponding key module 1 provides a first control signal ($V_1$) to the microprocessor 10, such that the microprocessor 10 is informed of the switching of the key 11 from the off state to the on state. The voltage at a common node ($n_1$) of the first resistor ($R_{11}$) and the first diode ($D_1$) of the drive circuit 13 is a logic high voltage signal when the key 11 is in the off state, and is a logic low voltage signal upon switching of the key 11 from the off state to the on state. The voltage at the common node ($n_1$) returns back to the logic high voltage level once the key 11 is released to restore the key 11 to the off state. In this embodiment, the logic low voltage signal at the common node ($n_1$) serves as the first control signal ($V_1$).

Figure 6:
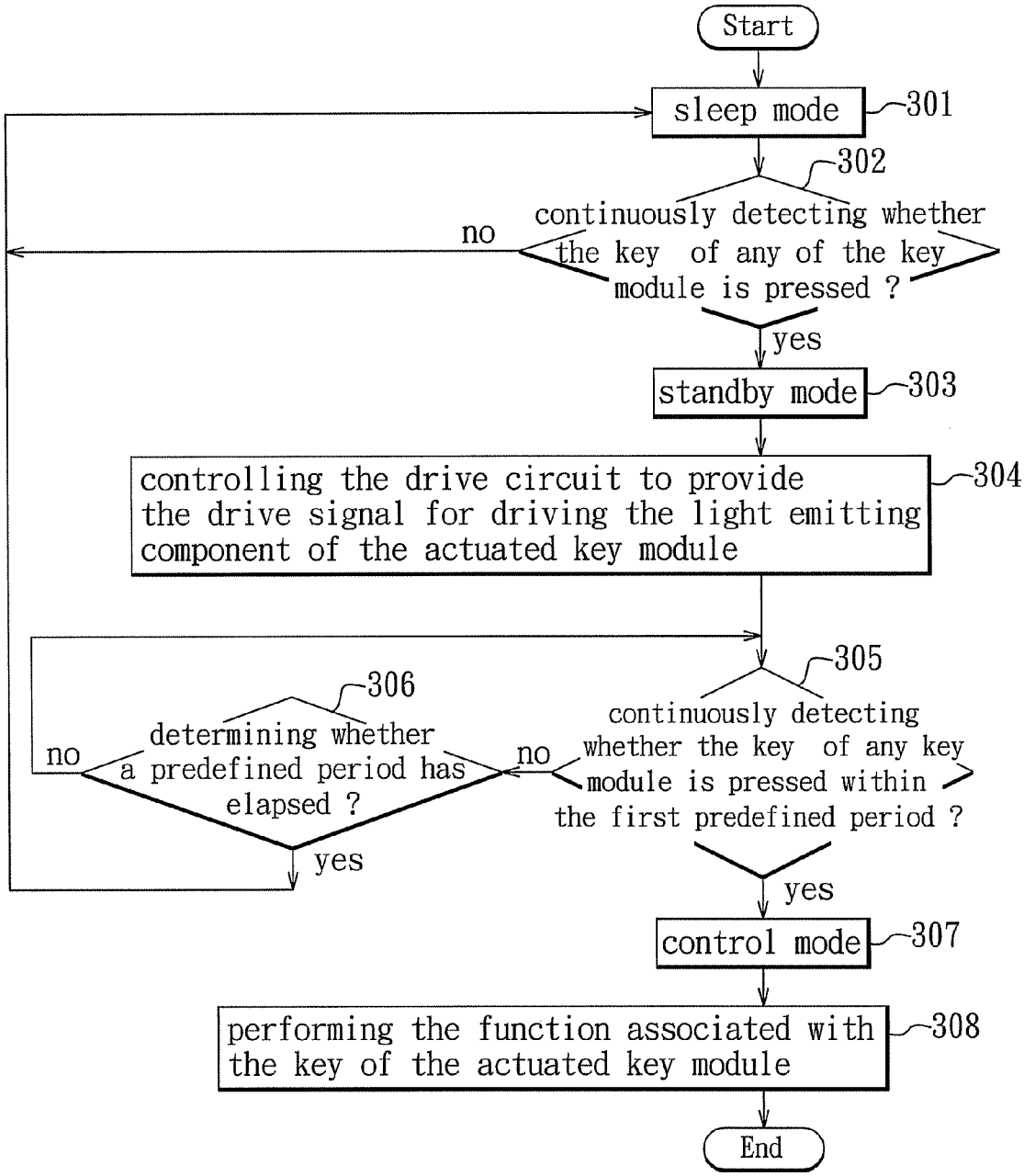
FIG. 6 is a flow chart of a method for controlling the key module according to the first preferred embodiment of the present invention.

As shown in FIG. 6 and FIG. 4, the microprocessor 10 is operable in one of a sleep mode, a standby mode, and a control mode. When the microprocessor 10 operates in the standby and sleep modes, the microprocessor 10 does not perform the function associated with the key 11. It is only when the microprocessor 10 operates in the control mode that the microprocessor 10 performs the function associated with the key 11. The method for controlling the key module 1 by the microprocessor 10 is described in the following. When an electronic device (not shown) incorporating the circuit 100' is turned on, the microprocessor 10 initially operates in the sleep mode (step 301). While the microprocessor 10 operates in the sleep mode, it continuously detects whether the key 11 (e.g., the fast-forward key) of any of the key modules 1 is pressed to actuate the corresponding key module 1 (step 302) In step 302, the microprocessor 10 detects that the key 11 of one of the key modules 1 is pressed upon receipt of a first control signal ($V_1$) from the drive circuit 13 of the one of the key modules 1. In particular, when the voltage at the common node ($n_1$) of the first resistor ($R_{11}$) and the first diode ($D_1$) of the drive circuit 13 of any of the key modules 1 switches from a logic high level to a logic low level, with the logic low voltage signal serving as the first control signal ($V_1$), the microprocessor 10 is informed of the switching of any of the key 11 from the off state to the on state, and in response, switches to operate in the standby mode (step 303). In the standby mode, the microprocessor 10 controls the drive circuit 13 to provide the drive signal 102 for driving the light emitting component 12 of the actuated key module 1, but does not perform the function, such as fast-forward, associated with the key 11 (step 304) of the actuated key module 1. The luminance of the indicating light provided by the light emitting component 12 of the actuated key module 1 decreases gradually over time. With the aid of the indicating light provided by the light emitting component 12 of the key module 1, the user verifies the key module 1 and chooses the key 11 of the desired key module 1.

Subsequently, the microprocessor 10 determines whether the key 11 of any, preferably desired, key module 1 is pressed within a first predefined period while the microprocessor 10 operates in the standby mode, i.e., the microprocessor 10 continuously detects whether the key 11 of any key module 1 is pressed within the first predefined period, i.e., whether another first control signal ($V_1$) from another actuated key module 1 is received by the microprocessor 10 (step 305). If the result in step 305 is "no", the microprocessor 10 determines whether a predefined period has elapsed (step 306). If the result in step 306 is "yes", the process returns back to step 301, where the microprocessor 10 switches to operate once more in the sleep mode. If the result in step 306 is "no", the process returns back to step 305.

Returning back to step 305, if the result in step 305 is "yes", i.e., if the microprocessor 10 determines that the key 11 of any key module 1 is pressed (or that the key 11 of the actuated key module 1 is continuously pressed) within the predefined period while the microprocessor 10 operates in the standby mode, the microprocessor 10 switches to operate in the control mode (step 307). In the control mode, the microprocessor 10 performs the function associated with the key 11 of the actuated key module 1 (step 308), which is mostly likely a desired actuated key module 1. The function may be fast-forwarding a video playback.

According to the above described process, a user may first press the key 11 of any key module 1 in the dark so as to operate the microprocessor 10 in the standby mode, where the light emitting component 12 of the actuated key module 1 is driven to provide the indicating light. The function associated with the actuated key module 1 is not performed by the microprocessor 10, thereby preventing undesired operation of the electronic device. With the aid of the indicating light provided by the light emitting component 12 of the actuated key module 1, whose luminance gradually decrease, the user may verify the actuated key modules 1 and press the key 11 of a desired key module 1 so as to operate the microprocessor 10 in the control mode, such that the function associated with the key 11 of the desired key module 1 is performed. Therefore, this method for controlling the key modules 1 facilitates the user to accurately operate the functions of the electronic device in the dark without accidentally operating an undesired function.

Figure 7A:
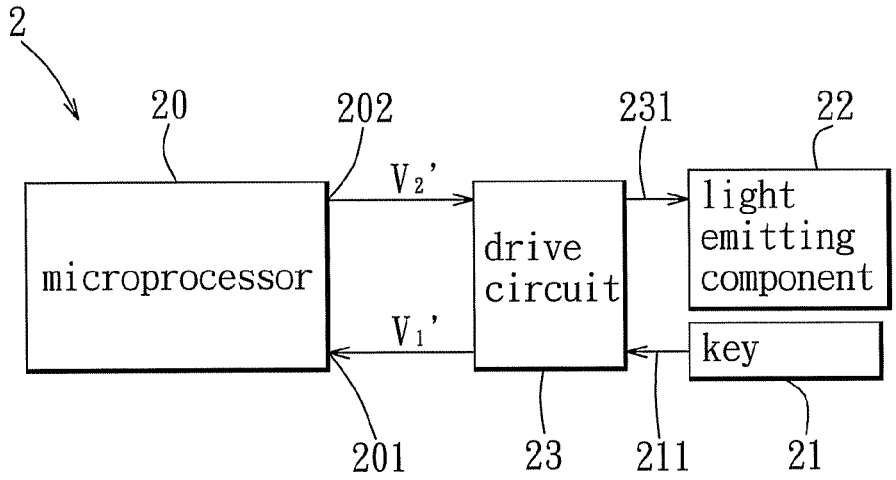
FIG. 7A is a block diagram of a first implementation of a key module according to a second preferred embodiment of the present invention.

As shown in FIG. 7A, a key module 2 according to a second preferred embodiment of the present invention is also adapted for use in an electronic device (not shown) that requires to be operated in the dark, such as a projector device. The key module 2 includes a microprocessor 20, a key 21, a light emitting component 22, and a drive circuit 23. In a first implementation of the second preferred embodiment, the microprocessor 20 includes first and second control terminals 201, 202 that are connected electrically to the drive circuit 23. The drive circuit 23 is connected electrically to the key 21 and the light emitting component 22. Upon switching of the key 21 from the off state to the on state, the key 21 provides an initial control signal 211 to the drive circuit 23. In response to the initial control signal 211, the drive circuit 23 provides a first control signal ($V_1'$) to the microprocessor 20 via the first control terminal 201, such that the microprocessor 20 is informed of the switching of the key 21 from the off state to the on state. Subsequently, the microprocessor 20 generates a second control signal ($V_2'$) on the basis of the first control signal ($V_1'$) provided by the drive circuit 23, and transmits the second control signal ($V_2'$) to the drive circuit 23 via the second control terminal 202. Next, the drive circuit 23 generates a drive signal 231 on the basis of the second control signal ($V_2'$) provided by the microprocessor 20, for driving the light emitting component 22 to provide the indicating light. In this implementation, the second control signal ($V_2'$) is a pulse width modulated signal. The second control signal ($V_2'$) and the drive signal 231 have intensities that gradually decrease over time. As a result, the luminance of the indicating light provided by the light emitting component 22 gradually decreases over time.

Figure 7B:
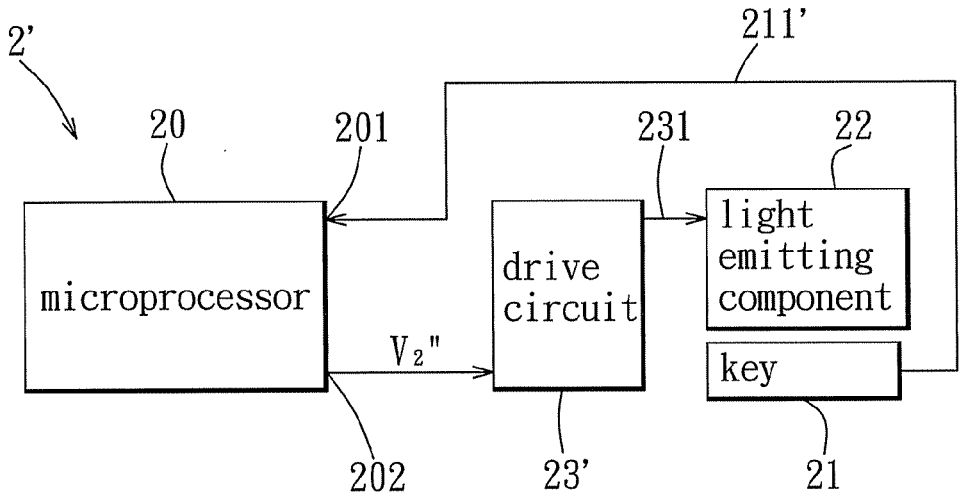
FIG. 7B is a block diagram of a second implementation of a key module according to the second preferred embodiment of the present invention.

As shown in FIG. 7B, a second implementation of a key module 2' according to the second preferred embodiment of the present invention differs from the first implementation in that the key 21 is connected directly and electrically to the microprocessor 20. In particular, upon switching of the key 21 from the off state to the on state, the key 21 provides an initial control signal 211' to the microprocessor 20 via the first control terminal 201 so as to inform the microprocessor 20 of the switching of the key 21 from the off state to the on state. In response to the initial control signal 211', the microprocessor 20 generates a control signal ($V_2''$), and transmits the control signal ($V_2''$) to the drive circuit 23' via the second control terminal 202. Subsequently, the drive circuit 23' generates the drive signal 231 on the basis of the control signal ($V_2''$) provided by the microprocessor 20, so as to drive the light emitting component 22 to provide the indicating light, whose luminance gradually decreases over time.

In the first and second implementations of the second preferred embodiment, the first control signal ($V_1'$) and the initial control signal 211' received by the microprocessor 20 via the first control terminal 201 are both logic low voltage signals, i.e., there is a change to the logic low voltage level upon switching of the key 21 from the off state to the on state. In addition, the second control signal ($V_2'$) and the control signal ($V_2''$) provided by the microprocessor 20 to the drive circuit 23, 23' are both pulse width modulated signals with intensities that gradually decrease over time. Consequently, the drive signal 231 also has an intensity that gradually decreases over time, and the luminance of the indicating light provided by the light emitting component 22 gradually decreases over time.

Referring back to FIG. 7A, a software approach of controlling the luminance of the indicating light is used in the first implementation of the second preferred embodiment, where a pulse width modulated signal with gradually decreasing intensity is provided by the microprocessor 20 as the second control signal ($V_2'$) As compared to the prior art, where the luminance of the indicating light provided by the light emitting component 931 (as shown in FIG. 1) is maintained at a constant level, the present invention effectively reduces the total energy consumption, while ensuring that the user is indeed informed of the actuation of the key 11 by the indicating light. Since the operation of the microprocessor 20 is identical to that described hereinabove in the first preferred embodiment with reference to FIG. 6, further details of the same are omitted herein for the sake of brevity.

Figure 8:
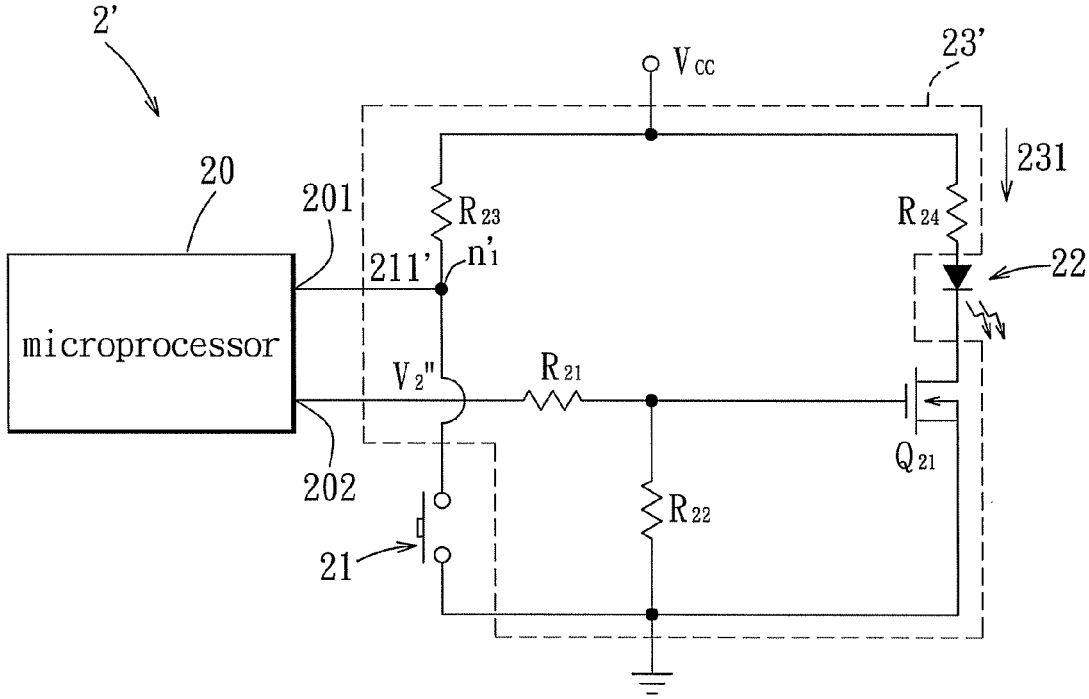
FIG. 8 is a circuit diagram, illustrating the drive circuit according to the second implementation of the second preferred embodiment of the present invention.

As shown in FIG. 7B and FIG. 8, the drive circuit 23' of the second implementation according to the second preferred embodiment of the present invention includes a transistor ($Q_{21}$), a first resistor ($R_{21}$), a second resistor ($R_{22}$), a third resistor ($R_{23}$), and a fourth resistor ($R_{24}$). The transistor ($Q_{21}$) has a grounded source, and a drain coupled to the light emitting component 22. The first resistor ($R_{21}$) is coupled between the second control terminal 202 of the microprocessor 20 and a gate of the transistor ($Q_{21}$). The second resistor ($R_{22}$) has a terminal that is coupled to the first resistor and the gate of the transistor ($Q_{21}$) and another terminal that is grounded. The third resistor ($R_{23}$) is adapted to be coupled between a voltage source ($V_{CC}$) and the key 21. The fourth resistor ($R_{24}$) is adapted to be coupled between the voltage source ($V_{CC}$) and the light emitting component 22. The first control terminal 201 of the microprocessor 20 is connected electrically to a junction of the third resistor ($R_{23}$) and the key 21 for detecting whether the key 21 is pressed.

When the key 21 is not pressed, the drive circuit 23' forms an open loop, the transistor ($Q_{21}$) is turned off, and the voltage at a common node ($n_1'$) of the third resistor ($R_{23}$) and the key 21 is a logic high voltage signal. At this time, the microprocessor 20 does not transmit the control signal ($V_2''$) to the drive circuit 23' via the second control terminal 202, where the voltage at the second control terminal 202 is 0 volt. Once the key 21 is pressed, the key module 2' is actuated, and the drive circuit 23' forms a closed loop, such that the voltage at the common node ($n_1'$) becomes a logic low voltage signal (0 volt), which serves as the initial control signal 211' provided by the drive circuit 23'. In response to the initial control signal 211', the microprocessor 20 transmits the control signal ($V_2''$) (approximately 5 volts) to the drive circuit 23' via the second control terminal 202, such that the transistor ($Q_{21}$) is turned on and such that the light emitting component 22 provides the indicating light. In this embodiment, each duty cycle of the pulse width modulated signal decreases gradually over time. Consequently, the electric current flowing through the light emitting component 22 decreases over time such that the luminance of the indicating light provided by the light emitting component 22 decreases over time. The electric current flowing through the light emitting component 22 serves as the drive signal 231 provided by the drive circuit 23'.

Figure 9:
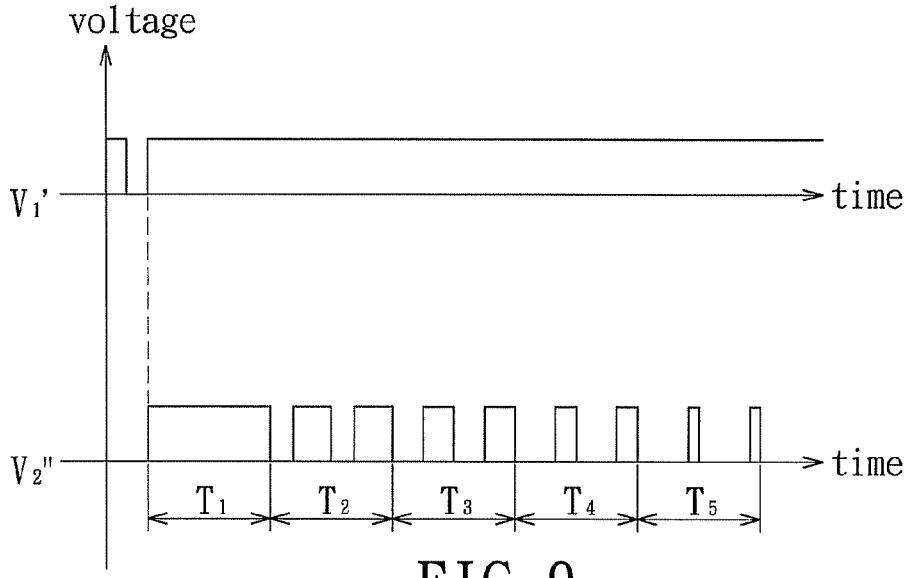
FIG. 9 is a plot illustrating first and second control signals according to the second implementation of the second preferred embodiment of the present invention.
Figure 10:
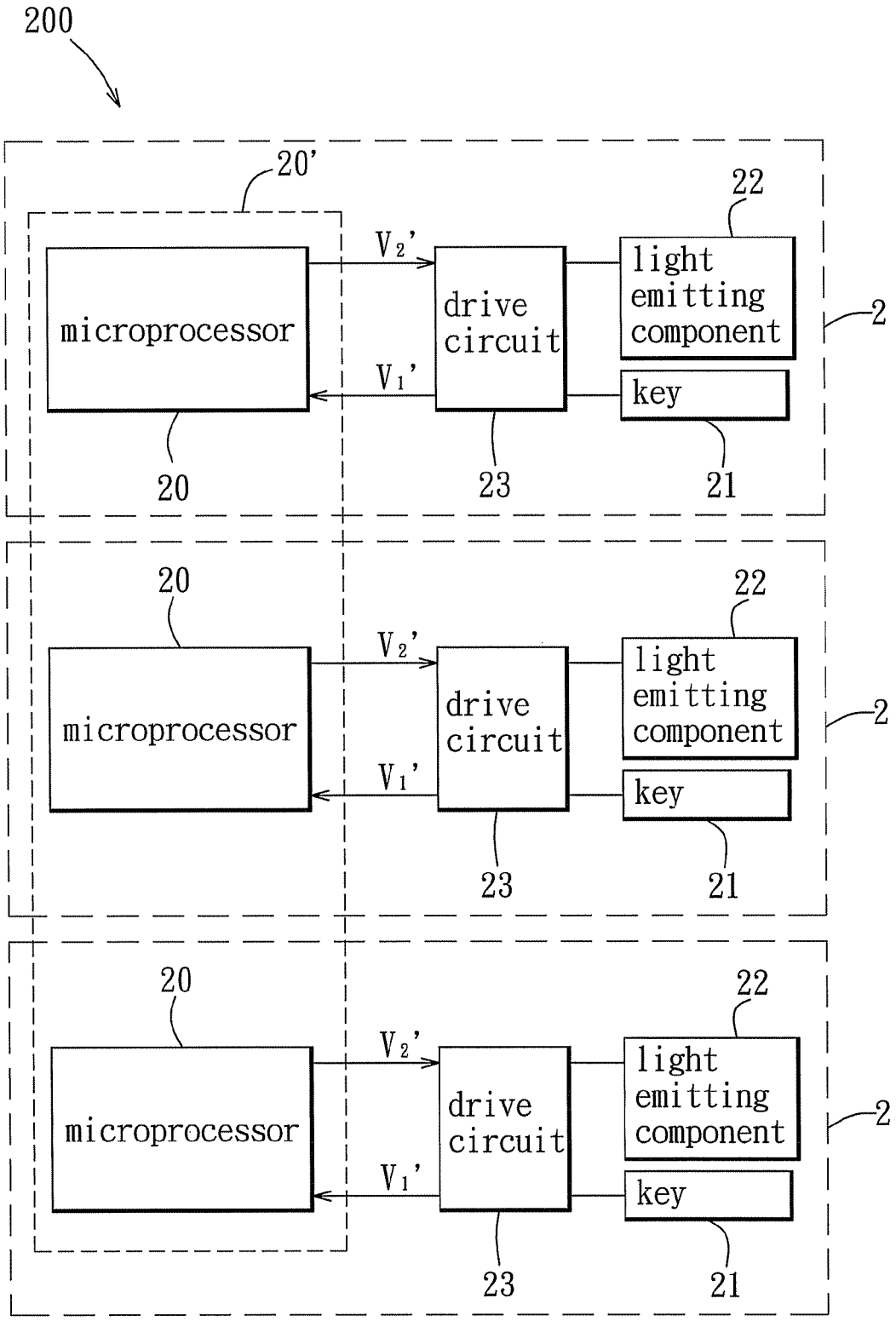
FIG. 10 is a block diagram, illustrating a circuit incorporating the key modules according to another second preferred embodiment of the present invention.

As shown in FIG. 8 and FIG. 9, the control signal ($V_2''$) is a logic high voltage signal throughout cycle period ($T_1$) such that the luminance of the indicating light provided by the light emitting component 22 is at its maximum level. At cycle period ($T_2$), the control signal ($V_2''$) is divided into four segments that alternate between logic high and logic low levels, where the pulse width of the logic high segments is slightly larger than that of the logic low segments, such that the luminance of the indicating light provided by the light emitting component 22 is reduced slightly from its maximum level. At cycle period ($T_3$), the control signal ($V_2''$) is divided into four segments that alternate between logic high and logic low levels, with the pulse width of the logic high segments being equal to that of the logic low segments, such that the luminance of the indicating light provided by the light emitting component 22 is reduced further from that at cycle period ($T_2$). The pulse width of the logic high segments gradually decreases in subsequent cycle periods ($T_4$), ($T_5$), etc. of the control signal ($V_2''$), until eventually the pulse width of the logic high segments is minimal (approaching zero), at which point the light emitting component 22 substantially ceases to provide the indicating light. Since the cycle period and the pulse width of the control signal ($V_2''$) can be adjusted by appropriate settings of the microprocessor 20, which are known in the art, disclosure of possible variations are omitted herein for the sake of brevity. As shown in FIG. 10, a circuit 200 incorporating key modules that have light-indicating functionality includes a plurality of the key modules 2 of the second preferred embodiment. Since each key module 2 is similar to that shown in FIG. 7 and FIG. 9, detail descriptions thereof will be omitted herein. When a user presses the keys 21 of various key modules 2 in sequence, the light emitting components 22 of the actuated key modules 2 will start and stop providing the indicating light in sequence at corresponding times. As a result, the user can verify whether the pressing sequence of the keys 21 was performed correctly by observing the order of vanishing of the indicating light provided by the light emitting components 22 of the actuated key modules 2.

In addition, the microprocessors 20 of the key modules 2 included in the circuit 200 can be integrated into a single microprocessor 20', i.e., the key modules 2 may share a common microprocessor 20', in other embodiments of the present invention. While the microprocessor 20' operates in the sleep mode, upon switching of the key 21 of one of the key modules 2 from the off state to the on state, the microprocessor 20' switches to operate in the standby mode, and transmits a control signal ($V_2'$) to the drive circuit 23 of the actuated key module 2, such that the drive circuit 23 drives the light emitting component 22 to provide the indicating light. In another approach, the microprocessor 20' transmits the control signal ($V_2'$) to the all drive circuits 23 of all of the key modules 2, such that the light emitting components 22 of all of the key modules 2 provide the indicating light. In the latter approach, the user can more clearly identify the location of the desired keys 21.

In sum, the present invention has the following advantages and effects:

1. While the microprocessor 10, 20 operates in the sleep mode, upon pressing of the key 11, 21 of any key module 1, 2 such that the key 11, 21 switches from the off state to the on state, the microprocessor 10, 20 operates in the standby mode, where the light emitting component 12, 22 of the actuated key module 1, 2 is driven by the drive signal 102, 231 to provide the indicating light with a luminance that gradually decreases over time. With the decreasing luminance of the indicating light, the user can once again press the key 11, 21 of a desired key module 1, 2 within a predefined period while the microprocessor 10, 20 operates in the standby mode, so as to make the microprocessor 10, 20 operate in the control mode, such that the function associated with the key 11, 21 of the desired key module 1, 2 is performed in the control mode. Therefore, the control method facilitates the user in accurately operating the functions of an electronic device incorporating the key modules 1, 2 of the present invention in the dark without accidentally operating an undesired function.

2. Since the luminance of the indicating light provided by the light emitting components 12, 22 decreases gradually over time, the total energy consumption of the key module 1, 2 is greatly reduced as compared to the prior art, where the luminance of the indicating light provided by the light emitting component 931 (as shown in FIG. 1) is maintained at a constant level.

3. Since one drive circuit 13, 13', 23, 23' and one light emitting component 12, 22 correspond to one key 11, 21, the light emitting components 12, 22 can provide the indicating light individually in correspondence with the keys 11, 21, as the keys 11, 21 are actuated. Therefore, total energy consumption of the present invention is again reduced as compared to the prior art, where all of the light emitting components 931 (as shown in FIG. 1) provide the indicating light whenever one of the keys 911 is actuated.

4. When a user presses the keys 11, 21 of different key modules 1, 2 in sequence, the light emitting components 12, 22 of the key modules 1, 2 will start and stop providing the indicating light in sequence at corresponding times. In particular, at any point in time, the indicating light provided by the light emitting component 12, 22 of an earlier actuated key module 1, 2 has lesser luminance than that of a later actuated key module 1, 2. Consequently, the user can confirm the operating sequence of the keys 11, 21 on the basis of the order that the light emitting components 12, 22 stop providing the indicating light.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly as certain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A key module comprising:

a key operable between on and off states;

a light emitting component disposed adjacent to the key, and capable of providing indicating light for the key; and a drive circuit electrically connected to the key and the light emitting component;

wherein the drive circuit is triggered upon switching of the key from the off state to the on state to provide a drive signal for driving the light emitting component to provide the indicating light, the drive signal having an intensity that gradually decreases over time once the key switches from the on state to the off state such that the indicating light provided by the light emitting component has a luminance that gradually decreases over time;

wherein the drive circuit includes a capacitor, the drive signal provided by the drive circuit being a discharge current of the capacitor, and wherein the drive circuit further includes:

a first transistor having a collector coupled to one terminal of the capacitor, the other terminal of the capacitor being grounded;

a second transistor having a collector coupled to the light emitting component, and a grounded emitter;

a first diode having a cathode terminal coupled to the key;

a first resistor adapted to be coupled between a first voltage source and an anode terminal of the first diode;

a second diode coupled between a base of the first transistor and the key;

a second resistor coupled between the base of the first transistor and an anode terminal of the second diode;

a third resistor adapted to be coupled between a second voltage source and an emitter of the first transistor;

a fourth resistor coupled between the collector of the first transistor and a base of the second transistor;

a fifth resistor coupled between the base of the second transistor and the emitter of the second transistor; and a sixth resistor adapted to be coupled between the second voltage source and the light emitting component.

2. A key system, comprising:

a plurality of key modules, each of the key modules includes:

a key operable between on and off states;

a light emitting component disposed adjacent to the key, and capable of providing indicating light for the key; and a drive circuit electrically connected to the key and the light emitting component, wherein the drive circuit is triggered upon switching of the key from the off state to the on state to provide a drive signal for driving the light emitting component to provide the indicating light, the drive signal having an intensity that gradually decreases over time once the key switches from the on state to the off state such that the indicating light provided by the light emitting component has a luminance that gradually decreases over time;

wherein the drive circuit includes a capacitor, the drive signal provided by the drive circuit being a discharge current of the capacitor, and wherein the drive circuit further includes:

a first transistor having a collector coupled to one terminal of the capacitor, the other terminal of the capacitor being grounded;

a second transistor having a collector coupled to the light emitting component, and a grounded emitter;

a first diode having a cathode terminal coupled to the key;

a first resistor adapted to be coupled between a first voltage source and an anode terminal of the first diode;

a second diode coupled between a base of the first transistor and the key;

a second resistor coupled between the base of the first transistor and an anode terminal of the second diode;

a third resistor adapted to be coupled between a second voltage source and an emitter of the first transistor;

a fourth resistor coupled between the collector of the first transistor and a base of the second transistor;

a fifth resistor coupled between the base of the second transistor and the emitter of the second transistor; and a sixth resistor adapted to be coupled between the second voltage source and the light emitting component.

* * * * *